US005178729A

United States Patent [19]

Janda

[11] Patent Number: 5,178,729

[45] Date of Patent: Jan. 12, 1993

[54] HIGH PURITY STRATIFIED TISSUE AND METHOD OF MAKING SAME

[75] Inventor: Bruce W. Janda, Neenah, Wis.

[73] Assignee: James River Corporation of Virginia, Richmond, Va.

[21] Appl. No.: 641,657

[22] Filed: Jan. 15, 1991

[51] Int. Cl.[5] ..... D21H 27/38

[52] U.S. Cl. ..... 162/101; 162/112; 162/129; 162/130

[58] Field of Search ..... 162/123, 129, 111, 112, 162/101, 190, 130, 109

[56] References Cited

U.S. PATENT DOCUMENTS

| | | | |
|---|---|---|---|
| 4,477,313 | 10/1984 | Andersson | 162/190 |
| 4,488,932 | 12/1984 | Eber et al. | 162/101 |
| 5,102,501 | 4/1992 | Eber et al. | 162/129 |

OTHER PUBLICATIONS

"Fiber Analysis of Paper and Paperboard", T 401 om-88, approved by the Physical Properties Committee of the Process and Product Quality Div., TAPPI.

"Enhancement Of Paper Properties and Fibre Economics Through Web Stratification" by Robert E. Page et al.

*Primary Examiner*—Peter Chin

*Attorney, Agent, or Firm*—Birch, Stewart, Kolasch & Birch

[57] ABSTRACT

A foam-formed nonlaminated stratified paper tissue and method of making the same includes a first zone of foam-formed paper tissue formed from a furnish of hardwood fiber. A second zone of foam-formed paper tissue is formed from a furnish of softwood fiber. The second zone is formed unitary and entangled with the first zone to form a nonlaminated stratified paper tissue. A high softness integument is defined adjacent to an outer surface of the first zone and a substratum is defined adjacent to a surface of the second zone spaced away from the integument. The integument on the outer surface of the first zone includes an enriched region having a substantial purity of hardwood fiber and the substratum on the surface of the second zone includes an enriched region having a substantial purity of softwood fiber. The enriched region of substantially pure hardwood fiber provides an extremely soft and smooth surface detectable by human somatic sensibility.

26 Claims, 11 Drawing Sheets

LAYER PURITY
REGION I (YANKEE SIDE)

LAYER PURITY
REGION 3

LAYER PURITY
REGION 6

LAYER PURITY
REGION 8 (AIR SIDE)

LAYER PURITY
COMPOSITE OF TOTAL SHEET

HIGH PURITY STRATIFIED TISSUE AND METHOD OF MAKING SAME

BACKGROUND OF THE INVENTION

1. Field of the Invention

A foam-formed nonlaminated stratified paper tissue includes a first zone of foam-formed paper tissue formed from a furnish of hardwood kraft. A second zone of foam-formed paper tissue is formed from a furnish of softwood kraft. The second zone is formed unitary and entangled with the first zone to form a nonlaminated stratified paper tissue having a high softness integument on an outer surface of said first zone which is an enriched region having a substantial purity of hardwood kraft. The enriched region provides an extremely soft and smooth surface detectable by human somatic sensibility.

2. Description of Background Art

Hithertofore, paper tissues have been constructed and formed by utilizing a water-forming process wherein fiber blend is suspended in a liquid solution and delivered from a headbox onto a twin wire, Fourdrinier, suction breast roll former or crescent former machine. The water-formed tissue may be produced to include one or more layers formed by multiple headboxes. In addition, a headbox may be utilized having a single slice outlet or a plurality of slice outlets depending on the number of regions in the product desired to be produced. The water-formed tissues which are formed as a multilayer product by means of multiple headboxes tend to delaminate. Delamination is a phenomena whereby individual regions may be separated one from another, the interface between the regions is not so highly entangled as to prevent the separation of the various regions in a multilayer water-formed tissue.

Further, in a water-formed process, the furnish which is supplied to the headbox includes typically 0.15% by weight of fibers. If a two-slice outlet is provided in the headbox, two distinct furnishes may be supplied to each portion of the headbox so as to form regions which are predominantly composed of the fibers of the particular furnish which is supplied to the separate sections of the headbox. For example, a softwood kraft may be supplied to one portion of the headbox. Softwood kraft is produced from wood fibers which are relatively long in length. The second section of the headbox may be supplied with a 0.15% furnish of hardwood kraft. Hardwood kraft is formed from wood fibers having fiber lengths which are relatively short.

In a conventional water-formed papermaking process, approximately 50% to 60% of the furnish which is supplied to a Yankee tissue machine is retained on the wire. In other words, approximately 40% to 50% of the furnish supplied to the wire is actually recycled back into the furnish which is eventually supplied to the two sections of the headbox. The fibers which are not retained on the wire are recirculated through a collection pit back into the supply line for the headbox which contains the 0.15% by weight of fibers. Pure 3% softwood kraft supply pulp or the 3% hardwood kraft supply pulp is also supplied to the supply line for the appropriate headbox to be mixed in to form the 0.15% furnish. Since 40% to 50% of the material supplied to either the softwood kraft or the hardwood kraft is a mixture of long papermaking fibers or short papermaking fibers which are drained from the wire as the furnish is deposited thereon, the purity of the softwood kraft and the hardwood kraft as it is supplied to the two sections of the headbox is diluted. For example, if over 50% of the fines are not retained on the wire, these undesirable fines would be recirculated back into the softwood kraft pulp and the hardwood kraft pulp for eventual supply to the two sections of the headbox and the softwood kraft and the hardwood kraft would only be provided with new material to the flow lines for the headbox as the system reaches equilibrium state. Thus, the material in each section of the headbox is not pure.

SUMMARY OF THE INVENTION

The present invention provides a foam-formed nonlaminated stratified paper tissue which includes a first zone of foam-formed paper tissue formed from a furnish of hardwood kraft. A second zone of foam-formed paper tissue is formed from a furnish of softwood kraft. The second zone is formed unitary and entangled with said first zone to form a nonlaminated paper tissue.

A high softness integument is defined on an outer surface of the first zone which includes an enriched region having a substantial purity of hardwood kraft. The enriched region provides an extremely soft and smooth surface detectable by human somatic sensibility.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 2A is a perspective enlarged schematic illustration of the characteristics of the hardwood kraft surface purity;

DETAILED DESCRIPTION OF THE PREFERRED EMBODIMENT

Figure 1A:
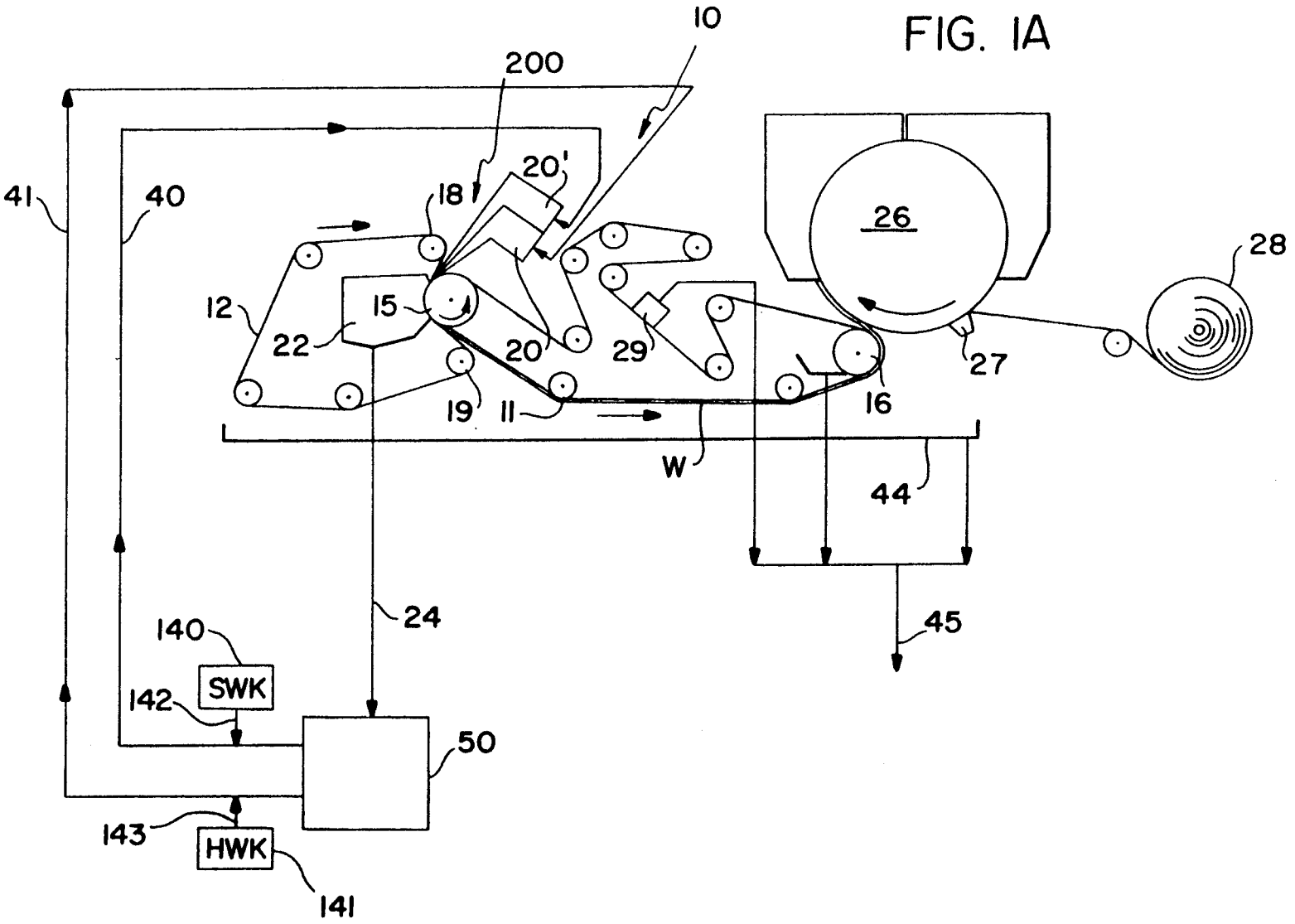
FIG. 1A is a schematic view illustrating two furnishes supplied to a foraminous support means for forming a paper tissue.

As illustrated in FIG. 1A, a papermaking machine 10, generally referred to as a crescent former, includes a web-forming end or wet end with a liquid permeable foraminous support member 11. The foraminous support member 11 may be constructed of felt, fabric or a synthetic filament woven mesh base with a very fine synthetic fiber batt attached to the mesh base. The foraminous support member 11 is supported in a conventional manner on rolls, including breast roll 15 and couch roll or pressing roll 16.

The particular papermaking machine illustrated in FIG. 1A is generally referred to as the crescent former. However, foam-formed paper, towels and tissue, may also be formed on a twin wire, Fourdrinier, suction breast roll former or other types of paper, towel and tissue making equipment. The present invention provides a degree of purity of stratification on crescent forming machinery beyond that previously demonstrated on this machinery and even surpassing that of the twin wire configuration which has been considered state of the art. A foam-formed paper, towel or tissue machine requires a save-all mechanism for permitting a recycling of the foam and surfactant which is utilized in supplying the furnish to the paper, towel or tissue making machine. Pressing wire 12 is supported on rolls 18 and 19 which are positioned relative to the breast roll 15 for pressing the press wire 12 to converge on the foraminous support member 11 at the cylindrical breast roll 15 at an acute angle relative to the foraminous support member 11. The foraminous support member 11 and the wire 12 move in the same direction and at the same speed which is the same direction of rotation of the breast roll 15. The pressing wire 12 and the foraminous support member 11 converge at an upper surface of the forming roll 15 to form a wedge-shaped space or nip into which one jet with two zones of foamed liquid-fiber dispersion is pressed between the pressing wire 12 and the foraminous support member 11 to force fluid through the wire 12 into a save-all 22 where it is collected as foamed liquid having an air content in the range of 45% to 80% by volume for reuse in the process.

A wet web W formed in the process is carried by the foraminous support member 11 to the pressing roll 16 where the wet web W is transferred to the drum 26 of a yankee drier. Fluid is pressed from the wet web W by pressing roll 16 as the web is transferred to the drum 26 of the yankee drier where it is dried and creped by means of a creping blade 27. The finished web is collected on a take-up roll 28.

Foamed liquid is collected from the foamed fiber furnish which is pressed between the pressing wire 12 and the foraminous support member 11. The foamed liquid is supplied to the save-all 22 and is returned through line 24 to a recycling process generally indicated by box 50. Box 140 generally indicates a supply of softwood kraft which in the form of a furnish having approximately 3% by weight of softwood kraft fibers. The furnish is supplied from the box 140 through the conduit 142 to the conduit 40. A portion of the recycled foam and fiber from the recycling process 50 is also supplied to the conduit 40 for supplying a furnish to a section 20' of a headbox 200. Similarly, box 141 illustrates hardwood kraft which is supplied in the form of a furnish having approximately 3% by weight of hardwood kraft fibers. The furnish in the box 141 is supplied through the conduit 143 to the conduit 41 for supplying hardwood kraft furnish to a section 20 of the headbox 200. Foam and furnish from the recycling box 50 is also supplied to the conduit 41 for use as a portion of the furnish supplied to the headbox 20.

A pit 44 is provided for collecting water, foam and surfactant squeezed from the furnish by the press roll 16 and a Uhle box 29. The water, foam and surfactant collected in the pit 44 may be collected into a flow line 45 for separate processing to remove surfactant and fibers from the water and to permit recycling of the water and the surfactant back to the papermaking machine 10.

The foam-formed nonlaminated stratified paper tissue of the present invention may be formed on a paper making machine 10 as described hereinabove. The softwood kraft furnish is supplied through the conduit 40 to a section 20' of the headbox 200. The hardwood kraft furnish is supplied through the conduit 41 to the section 20 of the headbox 200. Approximately 70% to 90% of the furnish supplied to the foraminous support member 11 is retained thereon to form a portion of the paper tissue. Only 10% to 30% of the fibers in the softwood kraft and the hardwood kraft are provided to the save-all 22 for recycling through the recycling process generally indicated by box 50. Thus, the supply box 140 will supply 70% to 90% of the softwood kraft to the section 20' of the headbox 200 with 10% to 30% of the furnish being supplied from the recycling process 50. Similarly, 70% to 90% of the hardwood kraft will be supplied from the supply box 141 with 10% to 30% of the furnish being supplied to the conduit 41 from the recycling process 50. In this way, approximately 70% to 90% of the furnish supplied to either the section 20 or 20' of the headbox 200 will be substantially pure hardwood kraft or softwood kraft with only 10% to 30% of the furnish being a mixture of hardwood kraft and softwood kraft fibers which are recycled through the recycling process 50. The high retention rate of 70% to 90% is possible by utilizing a foam-formed papermaking machine.

FIG. 2A illustrates an enlarged perspective schematic view of a portion of a tissue web 300 formed by a foam-formed process according to the present invention. A first zone 301 is a foam-formed paper tissue formed from a furnish of hardwood kraft. A second zone 401 is a foam-formed paper tissue formed from a furnish of softwood kraft. The first zone 301 and the second zone 401 are formed unitary and entangled with each other to form the nonlaminated stratified paper tissue 300. Nonlaminated is defined as an adherence of the first zone to the second zone so as to prevent separation of the two zones.

Boundary sections 310, 410 are disposed between the first zone 301 and the second zone 401. The boundary sections used hereinafter refer to a transition zone which is ultra-light and smaller than a water formed transition zone. The boundary sections 310, 410 are entangled sections wherein short papermaking fibers from the hardwood kraft and long papermaking fibers from the softwood kraft are intermingled and entangled to provide an interface zone which will permit a multi-zone construction while eliminating delamination of the zones. The foam-formed paper tissue 300 does not permit delamination. This feature is distinct as compared to multi-layers water-formed paper tissues wherein the layers may actually be separated one from another. The entangled short fibers 303 and the entangled long fibers 403 can be seen in the interface 310, 410 disposed between the first zone 301 and the second zone 401.

A high softness integument 320 is defined adjacent to the outer surface of the first zone 301 of the web of paper tissue 300. The integument 320 includes an enriched region 330 having a substantial purity of hardwood kraft. Similarly, a substratum 420 is defined adjacent to a surface of said second zone spaced away from said integument. The substratum 420 includes an enriched region 430 having a substantial purity of softwood kraft.

The term integument means an outer covering. As used in this invention, the term refers to a section of the paper tissue defined adjacent to an outer surface of the first zone 301 on one side of the paper tissue 300. In the embodiment illustrated in FIG. 2B, the integument is defined adjacent to the outer surfaces of the two-ply tissue on both sides of the paper tissue 300A. In the embodiment illustrated in FIG. 2C, the integument is defined adjacent to the outer surface of the multi-zone tissue on both sides of the paper tissue 3000. Similarly, the term substratum means an underlying layer. As used in this invention, the term refers to a section of the paper tissue defined adjacent to a surface of the second zone 401 spaced away from the integument. In the embodiment illustrated in FIG. 2B, the substratum is defined as the central portion of the two-ply tissue 300A. In the embodiment illustrated in FIG. 2C, the substratum is defined in the central portion of the multizone tissue 3000 and is split into two sections.

Figure 2B:
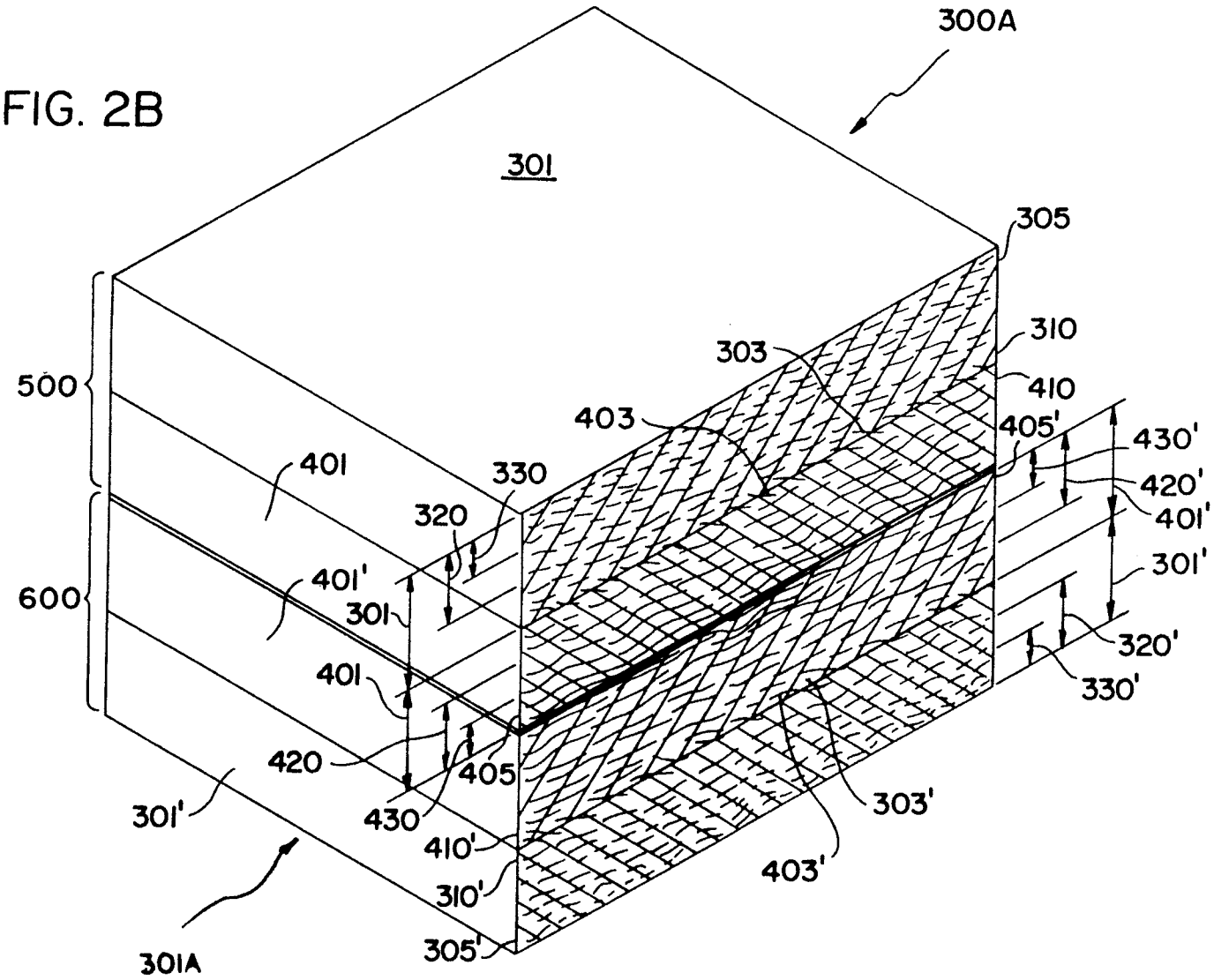
FIG. 2B is a perspective enlarged schematic illustration of a two-zone stratified paper tissue product.

FIG. 2B illustrates a foam-formed nonlaminated stratified paper tissue product which is composed of a first ply 500 and a second ply 600. The first ply 500 includes a first zone 301 which is a foam-formed paper tissue formed from a furnish of hardwood kraft. A second zone 401 is a foam-formed paper tissue formed from a furnish of softwood kraft. The discussion of the first zone 301 and the second zone 401 is set forth hereinabove.

Similarly, the second ply 600 includes a first zone 301' which is a foam-formed paper tissue formed from a furnish of hardwood kraft. A second zone 401' is a foam-formed paper tissue formed from a furnish of softwood kraft. The first zone 301' and the second zone 401' are formed unitary and entangled with each other in the same manner as the first ply 500.

Boundary sections 310' and 410' are disposed between the first zone 301' and the second zone 401'. The boundary sections 310' and 410' are entangled sections wherein short papermaking fibers from the hardwood kraft and long papermaking fibers from the softwood kraft are intermingled and entangled to provide an interface zone which will permit a multi-zone construction while eliminating delamination of the zones. Entangled short fibers 301' and entangled long fibers 401' can be seen in the interface boundary sections 310', 410' disposed between the first zone 301' and the second zone 401'. A high softness integument 320' is defined adjacent to an outer surface of the first zone 301' of the web of paper tissue 301A. The integument 320' includes an enriched region 330' having a substantial purity of hardwood kraft. Similarly, a substratum 420' is defined adjacent to a surface of the second zone 401' and is spaced away from the integument 320'. The substratum 420' of the second ply 600 is juxtaposed adjacent to the first ply 500. The substratum 420' includes an enriched region 430' having a substantial purity of softwood kraft.

The foam-formed nonlaminated stratified paper tissue product 300A illustrated in FIG. 2B provides a product having softwood kraft composed of recycled material or other fibers positioned in the central section of a two-ply product. In proprietary testing, this product has elicited wide consumer preference.

Figure 1B:
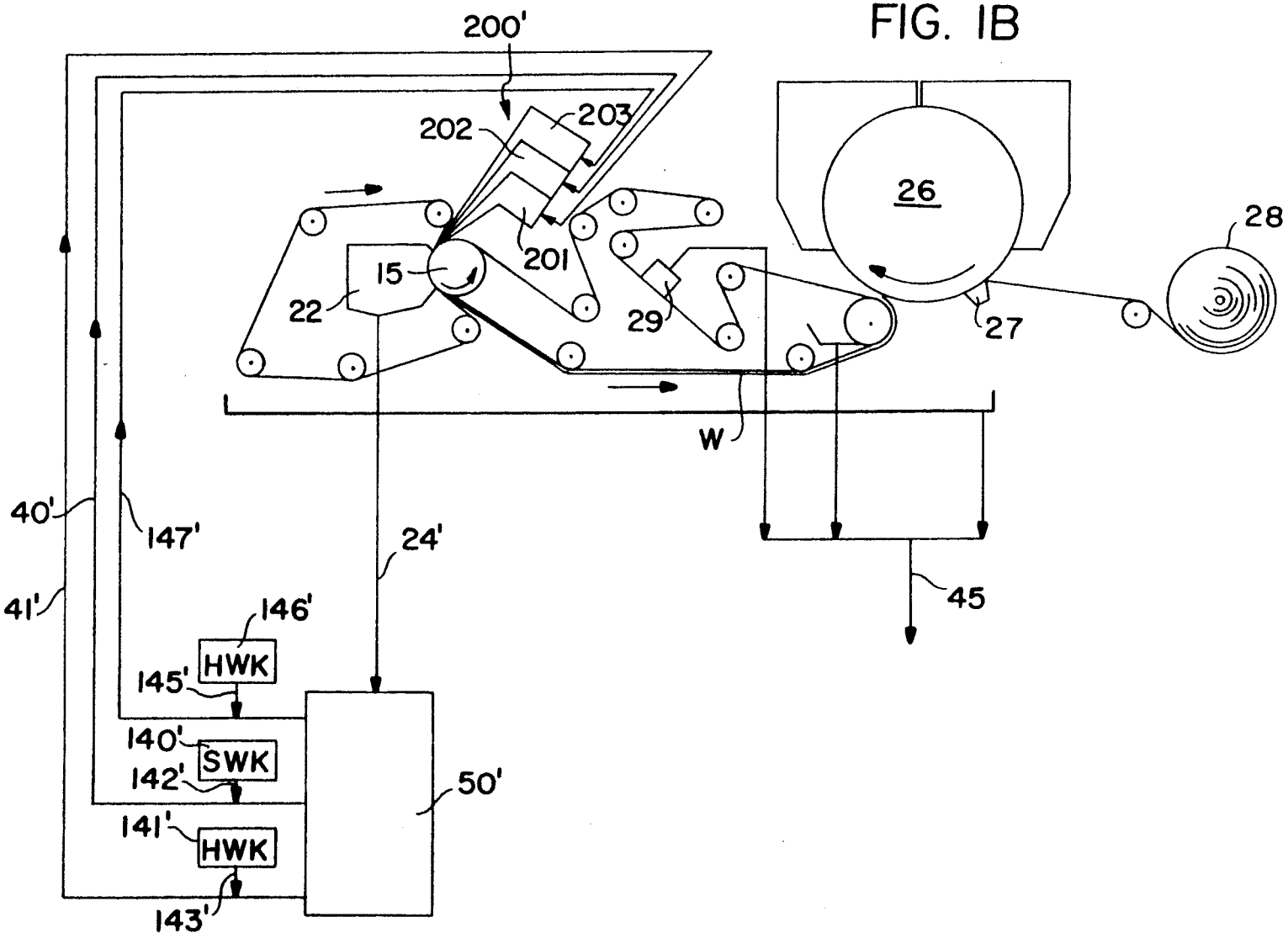
FIG. 1B is a partial schematic view illustrating a headbox divided into three sections with appropriate flow paths for supplying three furnishes thereto.

FIG. 1B is a schematic view of another embodiment of the present invention wherein a headbox 200' includes three sections 201, 202 and 203 and forms three slices for providing one jet with three zones of foamed liquid-fiber dispersion to the paper making machine. A return line 24' is connected between a save-all and a recycling process generally indicated by box 50'. Box 146' generally indicates a supply of softwood kraft which provides a furnish having approximately 3% by weight of hardwood kraft. The furnish is supplied from the box 146' through the conduit 145' to the conduit 147'. A portion of the recycled foam and fiber from the recycling process 50' is also supplied to the conduit 147' for supplying furnish to the section 203 of the headbox 200'.

Box 140' generally indicates a supply of softwood kraft which in the form of a furnish having approximately 3% by weight of softwood kraft fibers. The furnish is supplied from the box 140' through the conduit 142' to the conduit 40'. A portion of the recycled foam and fiber from the recycling process 50' is also supplied to the conduit 40' for supplying a furnish to a section 202 of a headbox 200'. Similarly, box 141' illustrates hardwood kraft which is supplied in the form of a furnish having approximately 3% by weight of hardwood kraft fibers. The furnish in the box 141' is supplied through the conduit 143' to the conduit 41' for supplying hardwood kraft furnish to a section 201 of the headbox 200'. Foam and furnish from the recycling box 50' is also supplied to the conduit 41' for use as a portion of the furnish supplied to the section 201 of the headbox 200'. The other elements illustrated in FIG. 1B are similar to the elements illustrated in FIG. 1A and are not further discussed herein.

Figure 2C:
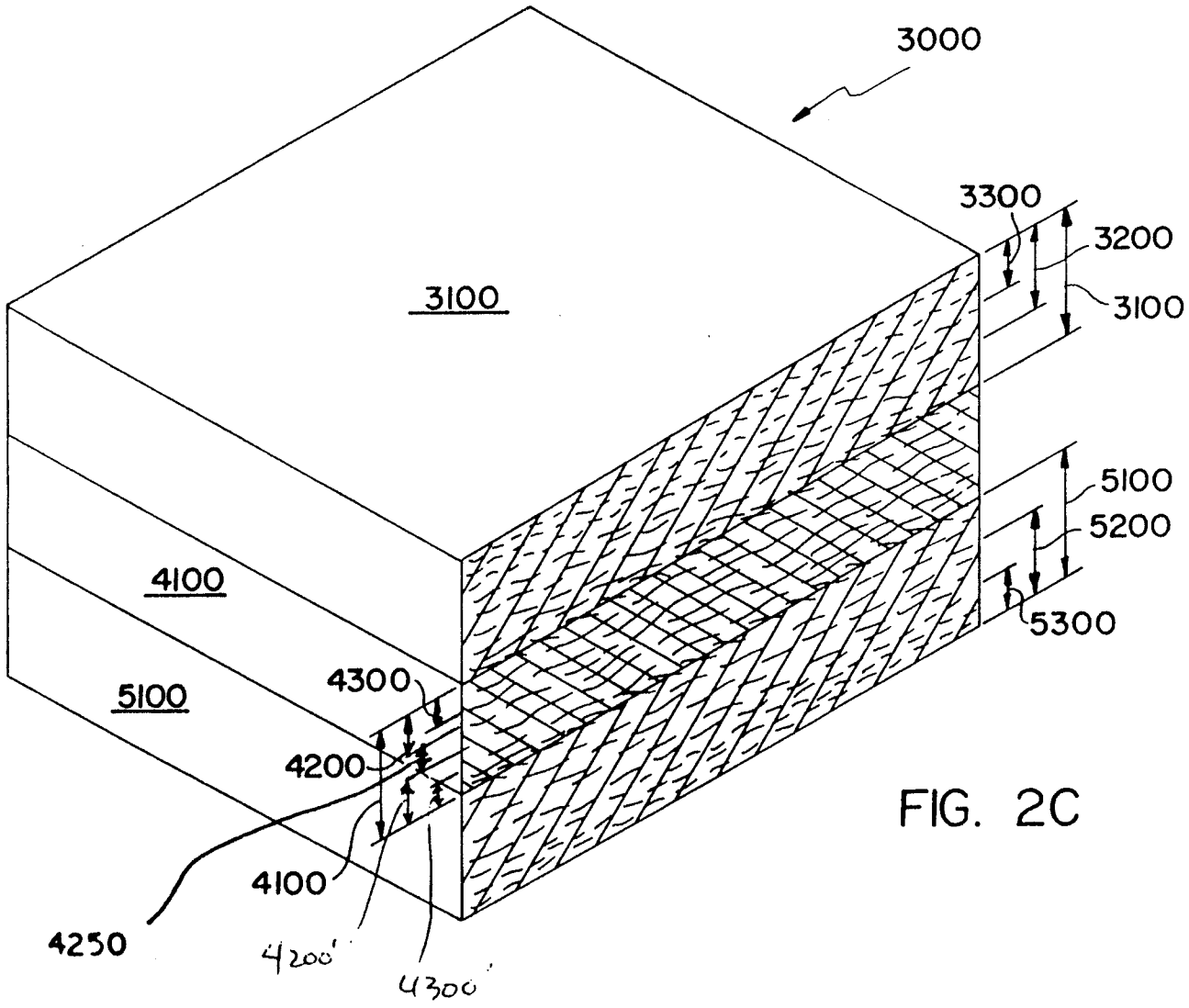
FIG. 2C is a perspective enlarged schematic illustration of a three-zone stratified paper tissue product.
Figure 3:
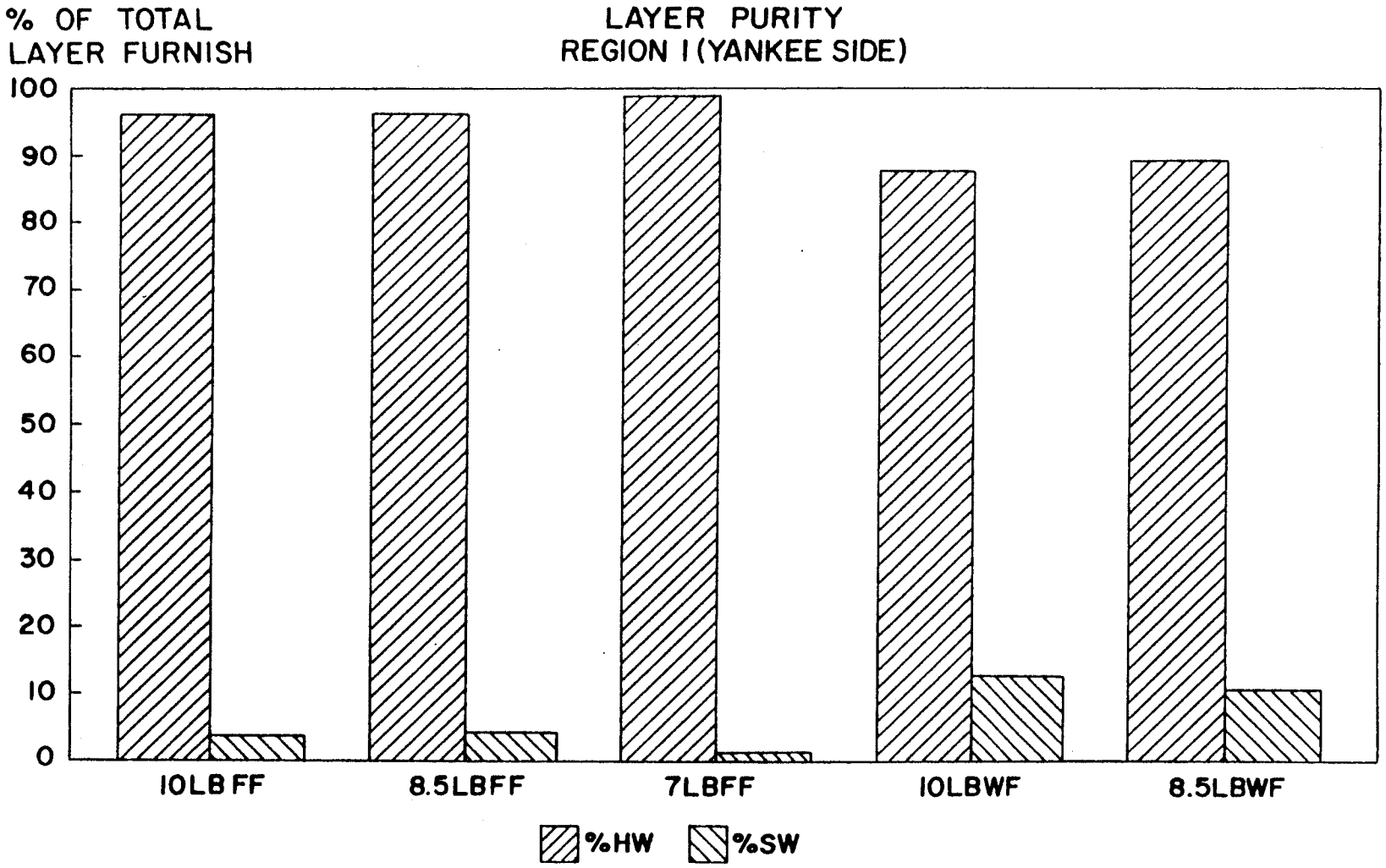
FIG. 3 illustrates data showing the layer of purity for the first region of the paper tissue.
Figure 4:
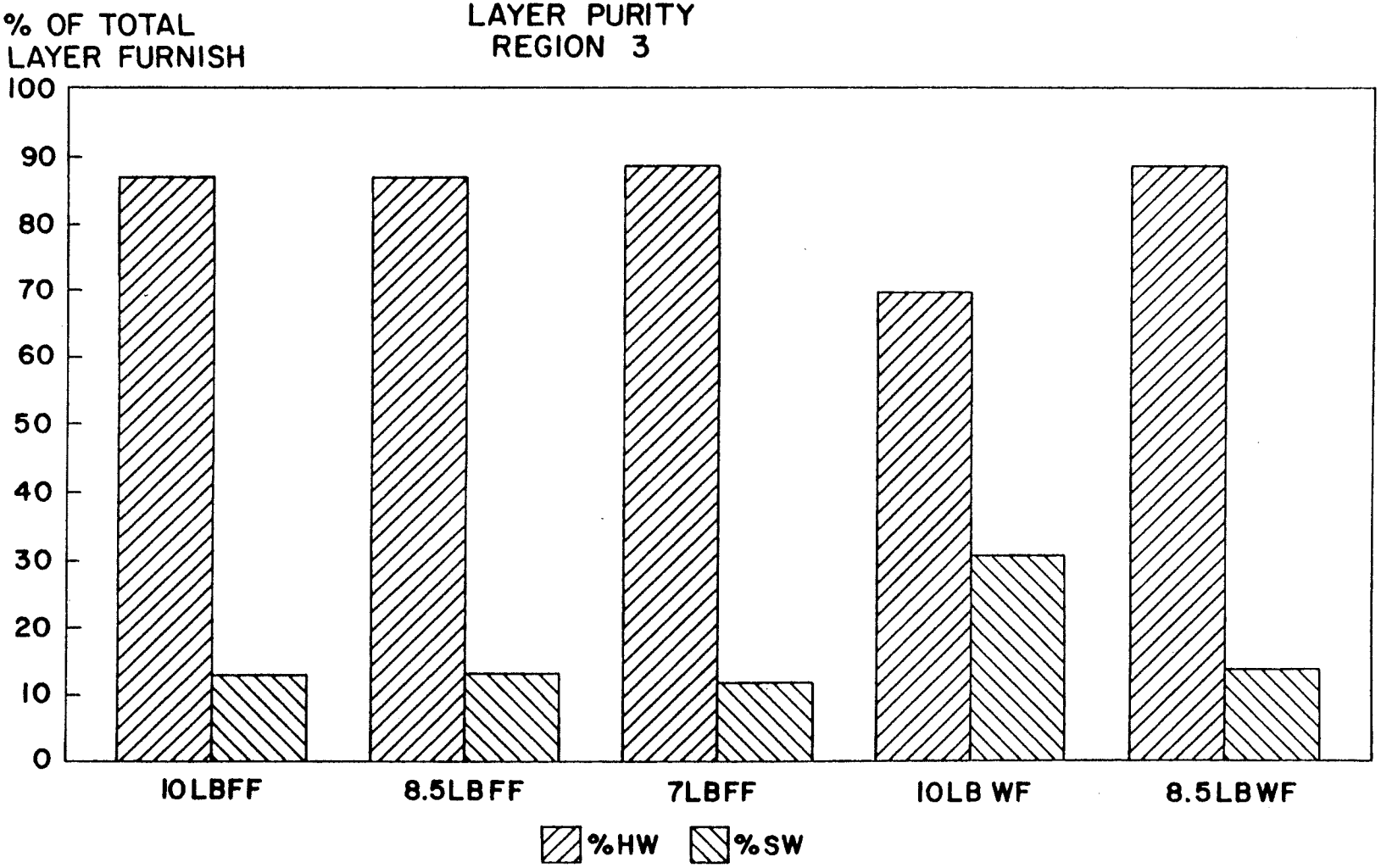
FIG. 4 illustrates data showing the purity of the third region of the paper tissue.
Figure 5:
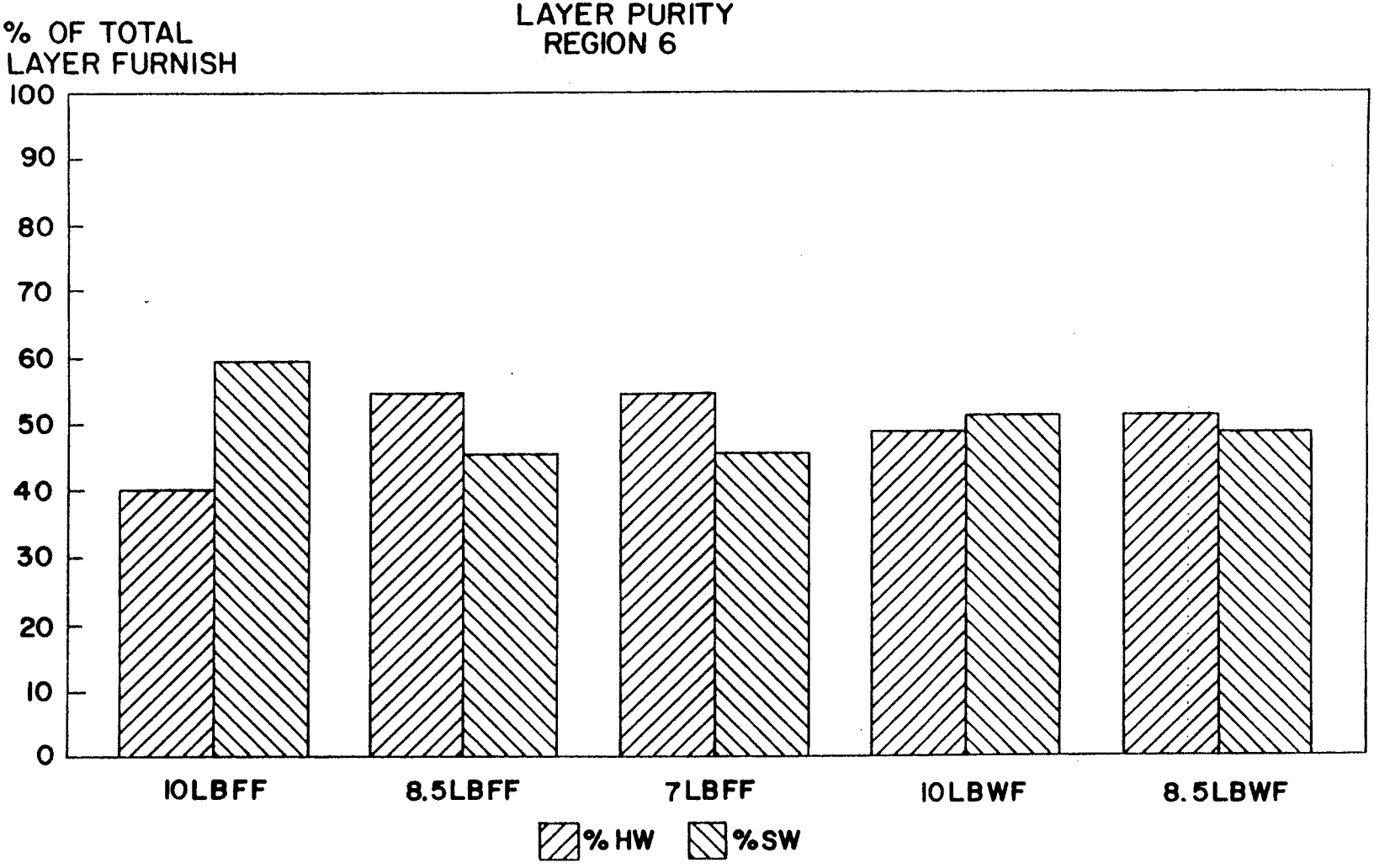
FIG. 5 illustrates data showing the layer of purity of the sixth region of the paper tissue.
Figure 6:
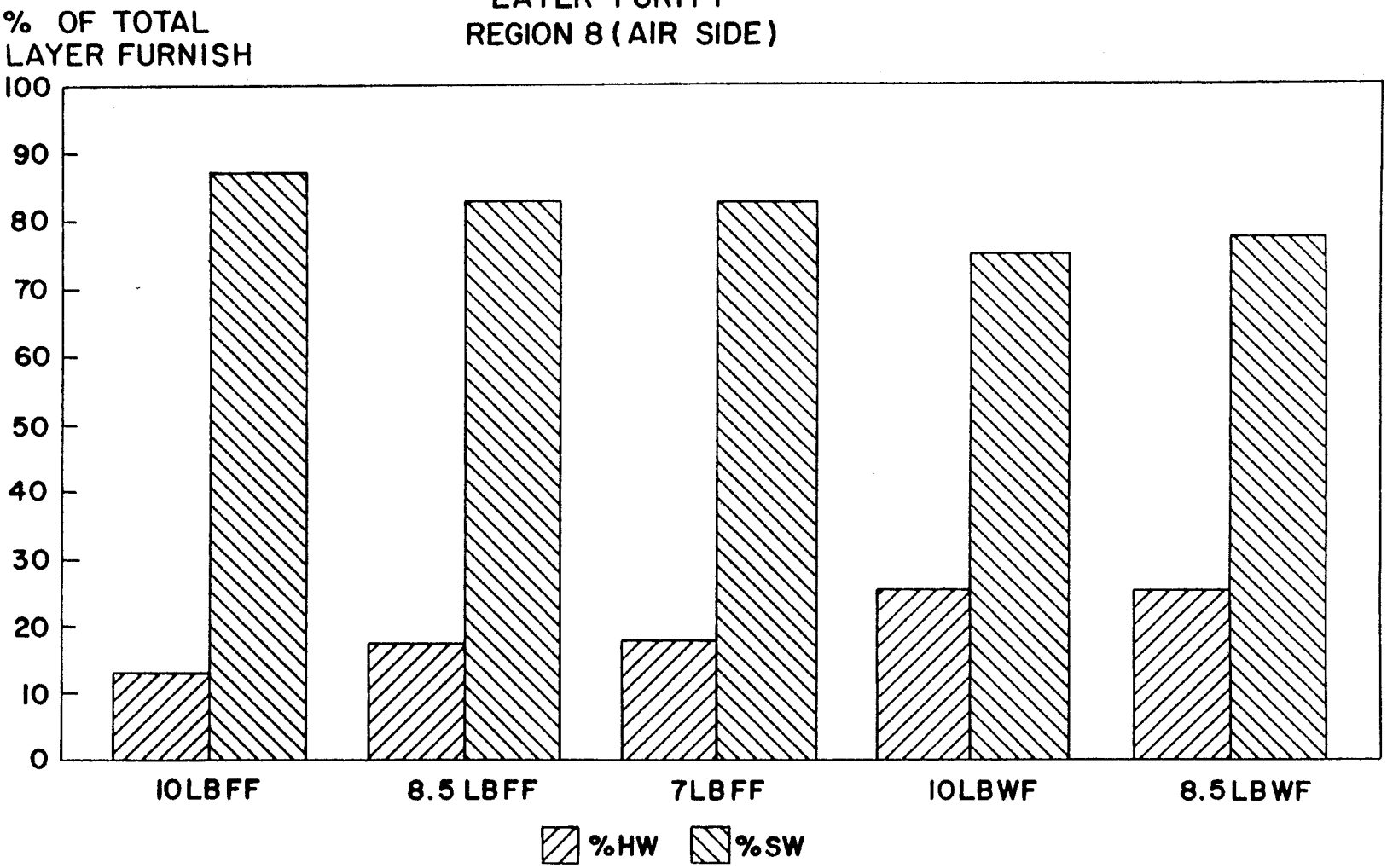
FIG. 6 illustrates data showing the layer of purity of the eight region of the paper tissue.
Figure 7:
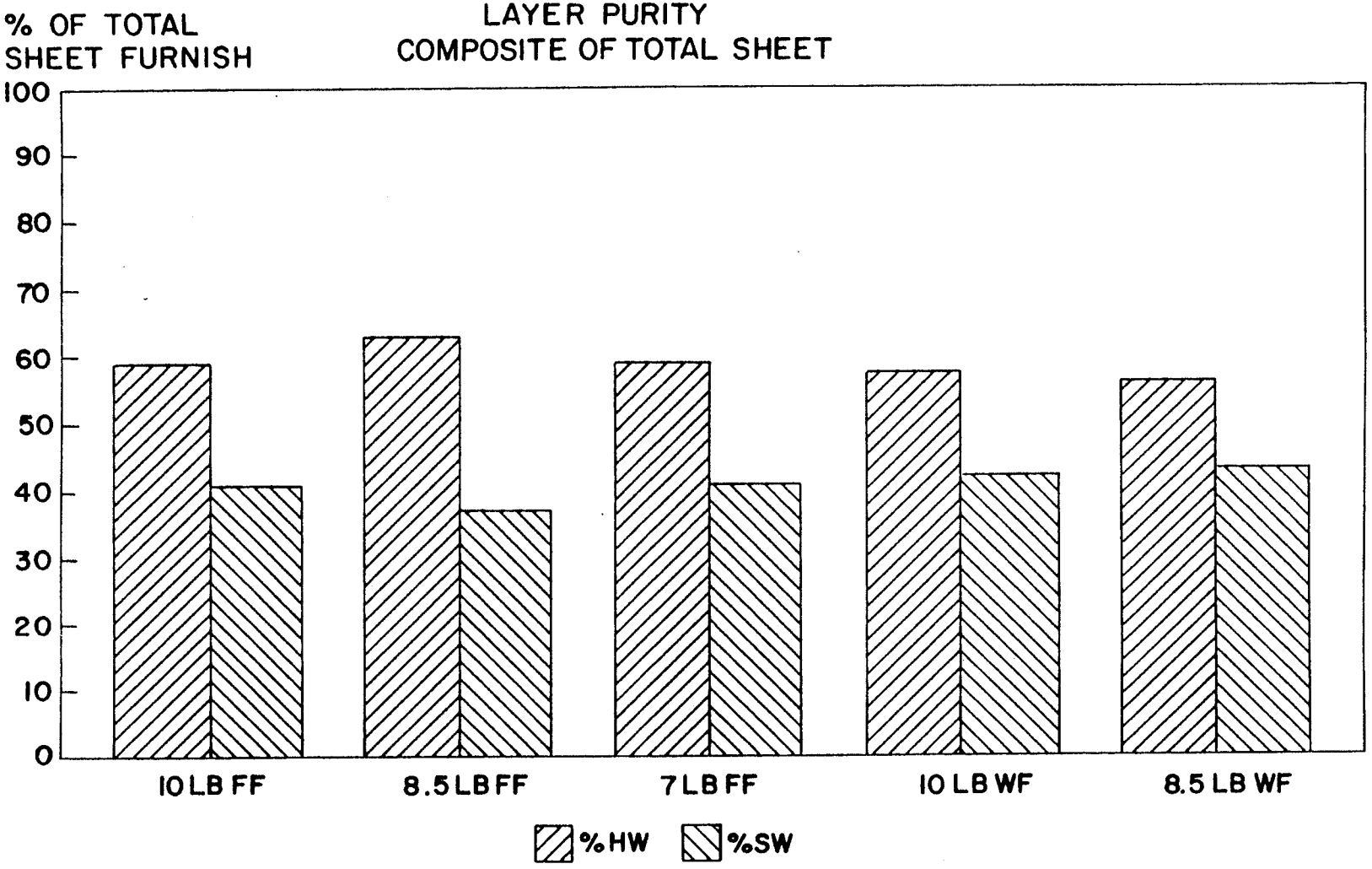
FIG. 7 illustrates data showing the composite of hardwood kraft as compared to softwood kraft of the material tested.

As illustrated in FIG. 2C, a paper tissue 3000 which includes three zones 3100, 4100 and 5100 is provided with a hardwood kraft being disposed on the outer surface of both sides of the paper tissue 3000.

FIG. 2C is an enlarged perspective schematic view of a portion of a tissue web 3000 formed by a foam-formed process according to the present invention. A first zone 3100 is a foam-formed paper tissue formed from a furnish of hardwood kraft. A second zone 4100 is a foam-formed paper tissue formed from a furnish of softwood kraft. A third zone 5100 is a foam-formed paper tissue formed from a furnish of hardwood kraft. The first zone 3100, the second zone 4100 and the third zone 5100 are formed unitary and entangled with each other to form the nonlaminated stratified paper tissue 3000.

Boundary sections are disposed between the first zone 3100, the second zone 4100 and the third zone 5100. The boundary sections are entangled sections wherein short papermaking fibers from the hardwood kraft and long papermaking fibers from the softwood kraft are intermingled and entangled to provide an interface zone which will permit a multizone construction while eliminating delamination of the zones. The foam-formed paper tissue 3000 does not permit delamination. This feature is distinct as compared to multi-layers water-formed paper tissues wherein the layers may actually be separated one from another. Entangled short fibers and entangled long fibers can be seen in the interface section disposed between the first zone 3100, the second zone 4100 and the third zone 5100.

High softness integuments 3200 and 5200 are defined adjacent to the outer surface of the first zone 3100 and 5200, respectively, of the web of paper tissue 3000. The integuments 3200 and 5200 include an enriched region 3300 and 5300, respectively, having a substantial purity of hardwood kraft. Similarly, substratums 4200, 4200' are defined adjacent to a surface of said second zone spaced away from the integuments 3200 and 5200, respectively. The region 4250 between the substratums 4200 and 4200' is an enriched region having a substantial purity of softwood kraft.

As illustrated in FIGS. 1A, 1B, 2A, 2B and 2C, the combination of foam-forming with a stratified headbox 200 or 200' provides a method and produces a product which has a significantly improved enriched region of purity of the stratified tissue product. Stratification is employed to position fibers in a product to yield the greatest economic and consumer benefits. A high quality fiber such as hardwood kraft can be positioned in a zone over a harsh furnish such as recycled fibers. Currently, hardwood kraft, especially eucalyptus, is an expensive fiber for use in producing paper, towels or tissue. Recycled fibers normally are mixtures of short and long fibers which often have a medium-to-rough texture when touched by an individual. Thus, the present invention provides a product and a process whereby the short fibers of hardwood kraft come in contact with the consumer so that a clean, soft product is produced making it possible to use lower quality recycle while preserving product quality. The hardwood kraft provides a surface coating which will cover and not have the same objectionable color as possibly the under zone of recycled fibers. Alternatively, the stratification can be used to achieve maximum consumer benefit by providing zones with all of the strong softwood fibers in an under zone and putting all of the soft hardwood fibers in the outer zone. In this way, the properties of each of the furnish components are employed in the best way to obtain the maximum consumer value.

The combination of foam-forming with stratification technology provides unexpected benefits by increasing the enriched region purity or definition of the zones. This allows the stratification affect to be achieved with less of the premium hardwood kraft pulp. In addition, the total sheet basis weight may be reduced. The present invention permits a harsh furnish such as recycled fibers to be utilized in producing a product without decreasing quality and while providing high consumer perception as to smoothness and softness.

A number of phenomena are observed in foam-forming which permits the stratification process to be improved. Foam-forming provides a higher first pass retention, thus reducing the amount of fibers which pass through the wire and are mixed back into the layers through the recycling process. The greatly improved formation of foam products allows the fibers in a zone to be more evenly distributed. Thus, a more uniform coverage of an undesirable zone, such as recycled fibers or other softwood kraft, is permitted with less of the hardwood kraft being added to the product. The increased viscosity of the foam which is mixed in with the furnish as it is supplied to the headbox also may tend to prevent mixing of the zones in the forming step. Further the velocity of the jet of the furnish having two or three zones and the velocity of the wire of the paper making machine also has to be taken into consideration to match the speed of the machine with the speed of the jet.

FIGS. 3–7 illustrate data showing the layer purity of four separate layers of a foam-formed nonlaminated stratified paper tissue according to the present invention. The testing method utilized in layering the paper tissue is a standardized Scotch tape method of extracting layers of fibers from a sheet in order to identify the layers for determination of stratification. A sheet of paper, towel or tissue is selected which is clean and free of folds, wrinkles and blemishes. The yankee side, drainage side and the machine direction of the sheet are determined. The sheet size should be approximately 27.9 centimeters (11 inches) to 35.56 centimeters (14 inches) in the cross machine direction for the length and 5.08 centimeters (2 inches) to 15.24 centimeters (6 inches) in the machine direction of the width.

A sample of paper, towel or tissue is placed on a flat surface with the yankee side up. Thereafter, a strip of tape of approximately 2.5 centimeters (1 inches) in width is removed from a roll of tape. The strip should be approximately 10.16 centimeters (4 inches) longer than the paper sample. Static is removed from the tape by wiping the smooth surface of the tape onto or with a soft, damp surface or air stream. The static-free sticky-side of the tape is applied to the top surface of the paper, towel or tissue. The tape is centered in the long direction of the sheet and lowered onto the sheet from one end to the other in a gentle touch-down manner. Air pockets are avoided. The tape is not pressed or touched on the surface. This tape is labeled No. 1 "YANKEE" side.

Thereafter, the paper, towel or tissue together with the tape is turned upside down. The tail ends of the tape are taped to the flat surface. A second strip of tape is applied to the opposite side of the taped specimen directly above the first strip of tape. This tape is labeled No. 4 or No. 8 depending on the number of pulls desired. The tape is identified as either No. 4 or No. 8 "DRAINAGE" side.

Thereafter, a paper cutter is utilized to trim 0.317 centimeters (⅛ inch) off each edge of the sample. A 2000 gram weight is rolled across the length of the tape specimen on the yankee surface and drainage surface, once on each side. Pressure is not exerted on the weight. The weight is moved at a uniform slow speed over the surface of the paper, towel or tissue. Subsequently, the two tapes are pulled apart at approximately a 180° angle at a uniform moderate speed. The tapes are not jerked or yanked.

The two fiber tape splits are positioned on a flat surface with the fiber surface up. The tail ends are taped down. A 2.54 centimeter (1 inch) strip of tape is applied to each half as previously done. The steps identified hereinabove are followed to split the ½ sheet fibers into ¼ and ⅛ splits, as desired, producing layers of fiber attached to tapes. The splits are identified in sequence starting from the yankee side of the paper, towel or tissue.

One end of the fiber tape splits is positioned in a petri dish half filled with water. A glue brush is utilized to firmly brush the fiber surface of the submerged sheet in one direction. The sample is slowly pulled in the opposite direction. Thus, wood fibers are removed from the tape into the petri dish. This solution is poured into a beaker. The brush and tape are rinsed as clean as possible of fibers into the beaker.

The extracted fibers are used as a standard fiber analysis specimen. The Technical Association of Pulp and Paper Industries (TAPPI) publishes guideline T-401 om-88 as the standard by which the hardwood and softwood fibers are analyzed to identify the various fibers as either hardwood or softwood fibers.

Utilizing the tape pull fiber extraction process identified hereinabove, the data set forth in FIGS. 3–7 was generated. The acronyms set forth in FIGS. 3–7 are identified as follows:

| Acronym | Meaning |
|---|---|
| FF | foam-formed |
| WF | water-formed |
| HW | hardwood kraft |
| SW | softwood kraft |

Of the samples identified in FIGS. 3–7, the foam-formed samples had a nominal basis weight of 10, 8.5 and 7 lbs. per ream. The water-formed sheets had a nominal basis weight of 10 and 8.5 lbs. per 3000 $ft^2$ ream. All sheets were nominally composed of 50% hardwood kraft and 50% softwood kraft. The sheets were made using stratified forming technology with all of the hardwood on the yankee side of the sheet and all of the softwood on the air side of the sheet.

The sheets were separated into eight regions by means of tape splits. Four of the regions (1, 3, 6, 8) were analyzed for percent hardwood and percent softwood. Region 1 corresponds to the outer surface of the hardwood kraft on the yankee side of the product. Region 8 corresponds to the softwood kraft on the air side of the second zone.

The data illustrated in FIGS. 3–7 are working examples as set forth numerically in the following table:

TABLE I

| | Zone Purity (weight % HW) | | | | |
|---|---|---|---|---|---|
| Sample ID | Region 1 | Region 3 | Region 6 | Region 8 | Composite |
| 10 lb FF | 96.5 | 87.1 | 40.3 | 12.8 | 59.1 |
| 8.5 lb FF | 96.1 | 86.8 | 54.7 | 17.1 | 63.1 |
| 7 lb FF | 99.1 | 88.5 | 54.5 | 17.5 | 59.0 |
| 10 lb WF | 87.5 | 69.6 | 48.8 | 25.0 | 57.7 |
| 8.5 lb WF | 89.5 | 86.5 | 51.4 | 24.5 | 56.5 |

Additional data to demonstrate the enriched regions of the paper tissue according to the present invention as compared to a water formed tissue is set forth numerically in the following tables:

TABLE IIA

| | Zone Purity | | | | | | |
|---|---|---|---|---|---|---|---|
| TRIAL WATER | Region 1 | Region 5 | Region 6 | Region 10 | Composite | fpm | J/W |
| 1 | 68 | 47 | 40 | 60 | 40 | 6500 | .81 |
| 2 | 47 | 52 | 46 | 66 | 45 | 6000 | .88 |
| 3 | 31 | 36 | 38 | 59 | 37 | 5500 | .96 |
| 4 | 40 | 38 | 37 | 49 | 40 | 5000 | .96 |
| 5 | 48 | 39 | 32 | 49 | 38 | 4500 | .96 |

TABLE IIB

| | Zone Purity | | | | | | |
|---|---|---|---|---|---|---|---|
| TRIAL FOAM | Region 1 | Region 5 | Region 6 | Region 10 | Composite | fpm | J/W |
| 1 | 50 | 34 | 41 | 48 | 36 | 6500 | .81 |
| 2 | 85 | 39 | 27 | 6 | 29 | 6000 | .88 |
| 3 | 92 | 39 | 32 | 6 | 35 | 5500 | .96 |
| 4 | 79 | 50 | 30 | 7 | 41 | 5000 | .96 |
| 5 | 91 | 39 | 24 | 5 | 33 | 4500 | .96 |

Please note that the percentages indicated hereinabove represent hardwood kraft. The percentage of hardwood kraft and softwood kraft for each of the layers will total 100%. Thus, in order to determine percentage of softwood kraft, one would merely add an appropriate percentage to the percentage identified. hereinabove to add up to a total of 100% for the particular regions of the zones. In addition, the acronym fpm refers to the feet per minute speed of the paper machine whereas the acronym J/W refers to the ratio of the jet to wire speed.

The test results set forth in Table IIA indicates that a water formed paper tissue in the trial runs consisted of a rather homogenous mixture of the hardwood and softwood fibers throughout the regions of the paper tissue. This result was achieved even though a separate furnish of hardwood fibers was supplied to one section of a headbox and a separate furnish of softwood fibers was supplied to a second section of a headbox.

The first trial run of a foam formed paper tissue as listed in Table IIB indicates that good stratification is not achieved when a large speed difference exists between the jet speed as compared to the speed of the forming wire of the machine.

In order to compare the results of the present invention, commercial tape splits of various products manufactured by the assignee of the present invention and products on the marketplace manufactured by others were tested to determine the percentage of hardwood kraft and softwood kraft in various regions of the layers of commercial products. The commercial products were manufactured with a water-forming technique. The results of the testing of commercial products are set forth in Tables III and IV:

TABLE III

| Commercial Product | Basis Weight | Region 1 | Region 3 | Region 6 | Region 8 | Composite |
|---|---|---|---|---|---|---|
| Brand A-1 | 19.4 | 72 | 41 | 35 | 14 | 29 |
| Brand A-2 | 19.7 | 81 | 68 | 59 | 48 | 62 |
| Brand A-3 | 20.0 | 84 | 67 | 33 | 10 | 41 |
| Brand A-4 | | 57 | 37 | 29 | 7 | 27 |
| Brand A-5 | | 84 | 49 | 32 | 10 | 28 |

All of the samples set forth above are two-ply paper tissues manufactured by the assignee of the present invention at three separate plants.

TABLE IV

| Commercial Product | Basis Weight | Region 1 | Region 8 | Region 14 | Region 20 | Composite |
|---|---|---|---|---|---|---|
| Brand X-1 | 17.7 | 95 | 69 | 72 | 85 | 72 |
| Brand X-2 | | 90 | 50 | 59 | 92 | 63 |
| Brand X-3 | | 98 | 35 | 60 | 97 | 71 |
| Brand X-4 | | 86 | 53 | 48 | 95 | 58 |
| Brand X-1 | 15.8 | 95 | 63 | 69 | 84 | 80 |
| Brand X-2 | | 90 | 49 | 62 | 92 | 61 |
| Brand X-3 | | 98 | 80 | 42 | 96 | 66 |
| Brand X-4 | | 85 | 50 | 44 | 86 | 58 |
| Brand X-1 | 17.8 | 98 | 67 | 78 | 94 | 81 |
| Brand X-2 | | 92 | 49 | 43 | 92 | 70 |
| Brand X-3 | | 97 | 81 | 30 | 97 | 73 |
| Brand X-4 | | 77 | 54 | 41 | 88 | 58 |
| Brand X-3 | 25.0 | 89 | 34 | 70 | 89 | 51 |

All of the samples set forth above are one-ply paper tissues with three zones manufactured by a competitor at four separate plants.

Please note that the percentages indicated hereinabove represent hardwood kraft. The percentage of hardwood kraft and softwood kraft for each of the layers will total 100%. Thus, in order to determine the percentage of softwood kraft, one would merely add an appropriate percentage to the percentage identified hereinabove to add up to a total of 100% for the particular regions of the zones.

The softwood kraft is a particular wood pulp which has relatively long fibers. Softwood trees growing on the western side of the Cascade mountain range in Washington and Oregon States yield fibers at somewhat greater length than those grown on the East. For example, the TAPPI handbook indicates that Douglas Fir from the coast side of the Cascades is assigned a weight factor of 1.4 whereas Douglas Fir from the inland side of the Cascades is assigned a factor of 0.90. When technicians attempt to determine fiber content, the stains which are used to distinguish hardwood fibers from softwood do not distinguish between East and West side softwoods often leading to inaccuracies in wood fiber content weight percentages. In addition, part of the furnish is supplied from a large quantity of wood from saw mills where the long softwood fibers are broken up when sawdust is used in the furnish leading to further difficulty assigning appropriate weight factors to each fiber. Thus, the test results identified hereinabove with regard to Brand A wherein a small percentage of hardwood kraft produces a large percentage of hardwood kraft on the outer surface is subject to clarification. The composite material which is utilized in Brand A has a unique characteristic wherein it is thus difficult to assign appropriate weight factors to the softwood kraft fibers leading to error in hardwood content estimates as well. The particular wood utilized in producing Brand A tissue does not fit within the normal definitions of softwood kraft and hardwood kraft as employed in the industry.

From the above Tables and FIGS. 3–7, it is clear that the purity of Region 1 according to the present invention is substantially higher, thus producing a soft and smooth surface for the foam-formed nonlaminated stratified paper tissue. For example, a high surface purity of at least 91% can be achieved even when the amount of hardwood used to form the first zone of the stratified paper product is no more than about 4.25 lbs per 3,000 sq. ft. ream. The hardwood kraft supplied as a furnish to the headbox and the softwood kraft supplied as a furnish to the headbox is actually supplied in a mixture of 50% by basis weight of softwood kraft and 50% by basis weight of hardwood kraft. The actual composite of the samples tested show the hardwood kraft in a range of 59% to 63.1% by basis weight. This relatively small percentage of hardwood kraft results in a surface purity in the range of 96.1% to 99.9% hardwood kraft. The present invention is quite an improvement over the water-formed paper tissues. More specifically, the products manufactured as Brand X require a hardwood kraft percentage in the range 66% to 81% in order to provide a surface purity of hardwood kraft in the range of 95% to 98%. In other words, if a large percentage of the furnish is hardwood kraft, it is inevitable that the percentage on the outer surface of the tissue will also be hardwood kraft. In contradistinction thereto, the present invention permits a smaller percentage of hardwood kraft to be applied as a furnish. The result achieved by the present invention with a smaller percentage of hardwood kraft in the composite material results in a larger percentage in the range of 96.1% to 99.1% surface purity of hardwood kraft. This percentage is substantially higher than the conventional water-formed tissues and produces a soft and smooth tissue which is desirable.

Figure 8A:
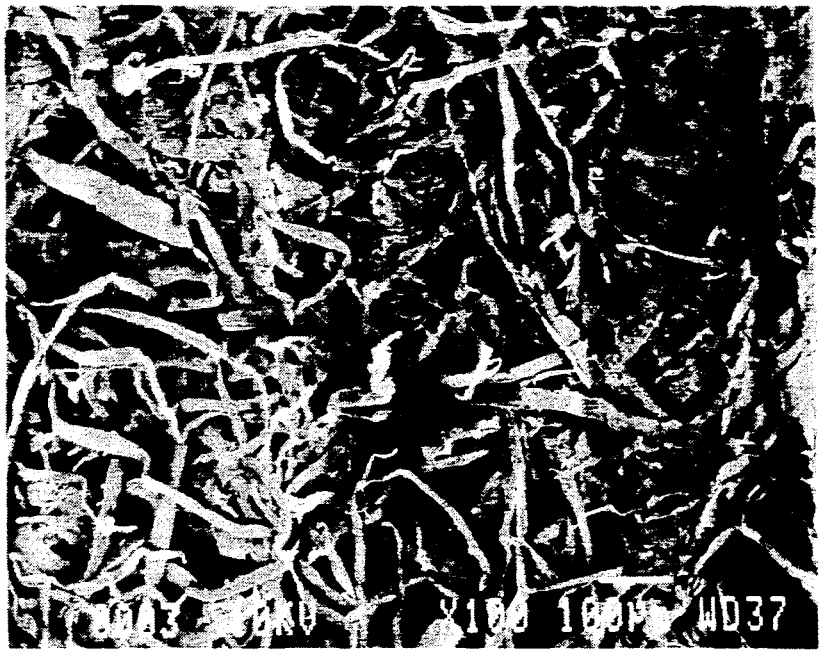
FIGS. 8A and 8B are an enlarged photographs showing surface purity in a water formed paper tissue.
Figure 8B:
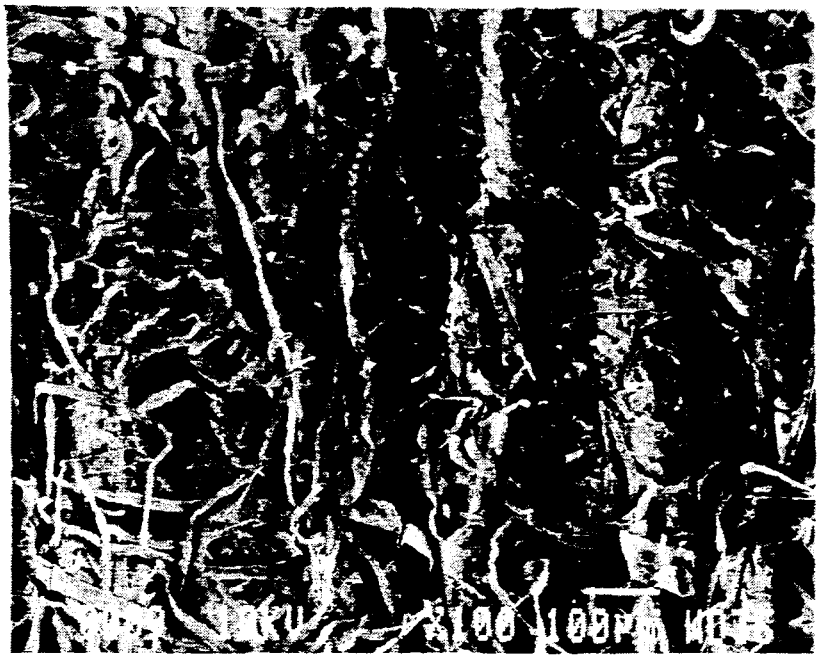

FIGS. 8A and 8B are an SEM microscopy surface views of a paper tissue which was constructed by using a water forming method. The enlarged photograph shows the composition of the fibers in the outer layer of the product.

Figure 9A:
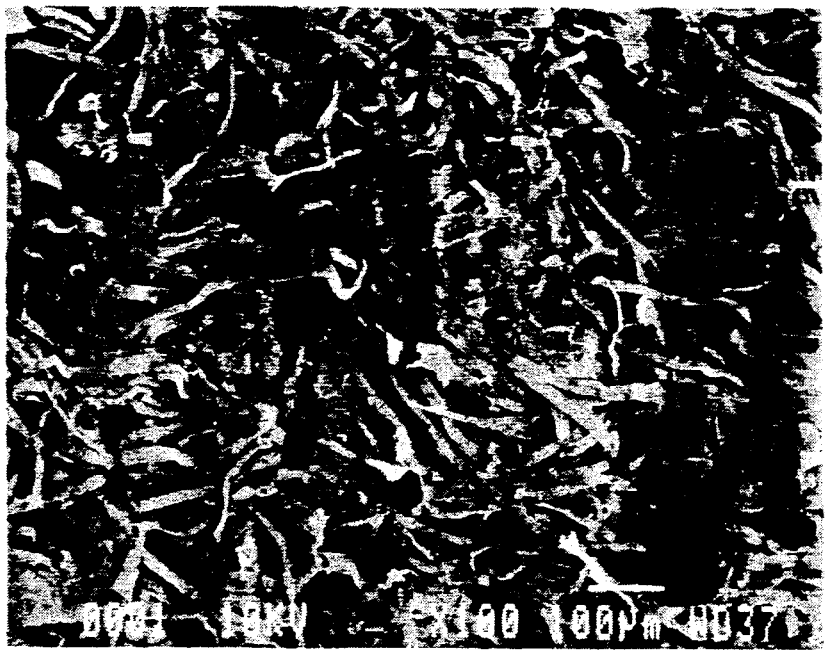
FIGS. 9A and 9B are an enlarged photographs showing surface purity in a foamed formed paper tissue.
Figure 9B:
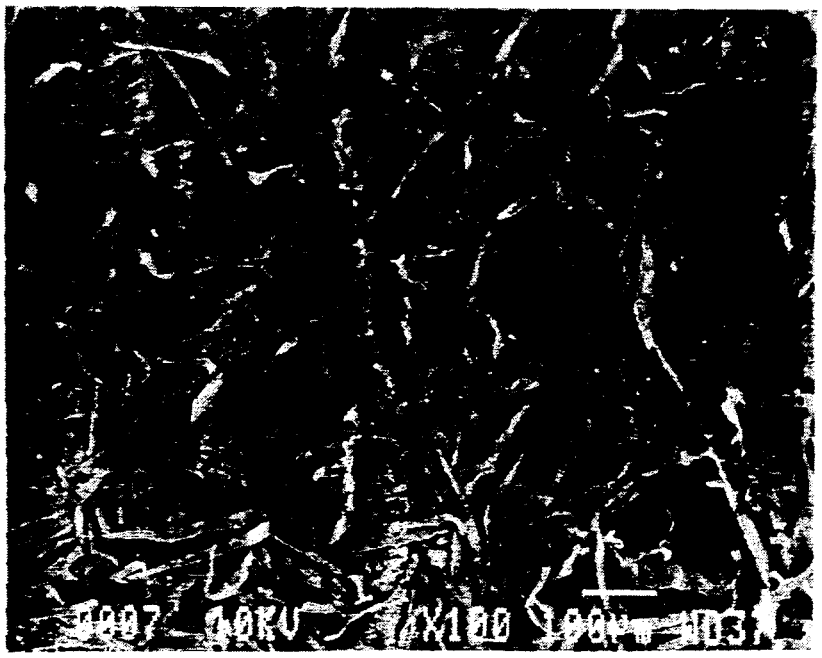

FIGS. 9A and 9B is an SEM microscopy cross-sectional views of a paper tissue which was constructed by using a foam forming method. The enlarged photograph shows the composition of the fibers in the product wherein the enriched regions in the first and second zones have a high degree of purity of hardwood fibers. Comparison with FIGS. 8A and 8B clearly shows the higher purity of the surfaces of products of the present invention.

In one embodiment of the present invention a foam-formed nonlaminated stratified paper tissue may be constructed having a first zone formed from a first foamed furnish consisting essentially of at least about 90% by weight hardwood fiber. A second zone may be formed from a second foamed furnish consisting essentially of at least about 70% by weight of softwood fiber. The second zone may be formed unitary and entangled with the first zone to form a nonlaminated stratified paper tissue. A high softness integument is defined adjacent to an outer surface of the first zone and consists essentially of at least about 80% by weight of fibers chosen from the group consisting of hardwood kraft fibers, or hardwood sulfite fibers, and up to about 10% by weight of strength enhancing softwood fibers. A substratum is defined adjacent to a surface of the second zone spaced away from the integument and consists essentially of at least about 65% by weight of strength and bulk enhancing fibers chosen from the group consisting of softwood fibers, secondary fibers, and anfractuous cellulosic fibers. The integument on the outer surface of the outer zone includes an enriched region having a concentration of hardwood fiber of above the greater of 80% by weight and at least 95% of the concentration of hardwood fiber in the first foamed furnish and the substratum includes an enriched region having a concentration of softwood fiber of at least about 95% of the concentration of softwood fiber in the second foam furnish, wherein the enriched region of substantially pure hardwood fiber provides an extremely soft and smooth surface.

In another embodiment foam-formed nonlaminated stratified paper tissue may be constructed having a first zone formed from a first foamed furnish consisting essentially of at least about 90% by weight hardwood fiber. A second zone may be formed from a second foamed furnish which consists essentially of at least about 70% by weight of fiber chosen from the group consisting of softwood kraft, secondary fibers, and anfractuous cellulosic fibers. The second zone is formed unitary and entangled with the first zone to form a nonlaminated stratified paper tissue. A high softness integument is defined adjacent to an outer surface of the first zone and consists essentially of at least about 95% by weight of fibers chosen from the group consisting of hardwood kraft fibers, and hardwood sulfite fibers, and up to about 5% by weight of strength enhancing softwood fibers. A substratum is defined adjacent to a surface of the second zone spaced away from the integument and consists essentially of at least about 65% by weight of strength and bulk enhancing fibers chosen from the group consisting of softwood fibers, secondary fibers, and anfractuous cellulosic fibers. The integument on the outer surface of the first zone includes an enriched region having a concentration of hardwood fiber of at least 95% of the concentration of hardwood fiber in the first foamed furnish with a basis weight of at least 2.5 lb/ream and no less than the basis weight of the fiber applied in the first furnish minus 1.5 lb/ream, wherein the enriched region of substantially pure hardwood fiber provides an extremely soft and smooth surface.

In still another embodiment of the present invention a foam-formed nonlaminated stratified paper tissue may be constructed having first and third zones formed from first and third foamed furnishes consisting essentially of at least about 90% by weight hardwood fiber. A second zone may be formed from a second foamed furnish consisting essentially of at least about 70% by weight of softwood fiber. The second zone may be formed unitary and entangled with the first and third zones to form a nonlaminated stratified paper tissue. High softness integuments are defined adjacent to outer surfaces of the first and third zones and consists essentially of at least about 80% by weight of fibers chosen from the group consisting of hardwood kraft fibers, or hardwood sulfite fibers, and up to about 10% by weight of strength enhancing softwood fibers. A substratum is defined in the second zone spaced between and away from the integuments and consists essentially of at least about 65% by weight of strength and bulk enhancing fibers chosen from the group consisting of softwood fibers, secondary fibers, and anfractuous cellulosic fibers. The integument on the outer surfaces of the outer zones includes enriched regions having a concentration of hardwood fiber of above the greater of 80% by weight and at least 95% of the concentration of hardwood fiber in the first foamed furnish and the substratum includes an enriched region having a concentration of softwood fiber of at least about 95% of the concentration of softwood fiber in the second foam furnish, wherein the enriched regions of substantially pure hardwood fiber provide extremely soft and smooth surfaces.

In yet another embodiment foam-formed nonlaminated stratified paper tissue may be constructed having first and third zones formed from foamed furnishes consisting essentially of at least about 90% by weight hardwood fiber. A second zone may be formed from another foamed furnish which consists essentially of at least about 70% by weight of fiber chosen from the group consisting of softwood kraft, secondary fibers, and anfractuous cellulosic fibers. The second zone is formed unitary and entangled with the first and third zones to form a nonlaminated stratified paper tissue. The high softness integuments are defined adjacent to an outer surface of the first zone and consist essentially of at least about 95% by weight of fibers chosen from the group consisting of hardwood kraft fibers, and hardwood sulfite fibers, and up to about 5% by weight of strength enhancing softwood fibers. A substratum is defined in the second zone spaced away from the integuments and consists essentially of at least about 65% by weight of strength and bulk enhancing fibers chosen from the group consisting of softwood fibers, secondary fibers, and anfractuous cellulosic fibers. The integuments on the outer surface of the first and third zones include enriched regions having a concentration of hardwood fiber of at least 95% of the concentration of hardwood fiber in the first and third foamed furnishes with a basis weight of at least 2.5 lb/ream and no less than the basis weight of the fiber applied in the first and third furnishes minus 1.5 lb/ream, wherein the enriched regions of substantially pure hardwood fiber provide extremely soft and smooth surfaces.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A foam-formed non-laminated stratified paper tissue wherein said paper tissue is formed from an overall furnish being supplied with hardwood fiber of no more than approximately 50% by weight of the paper tissue and strength and bulk enhancing fibers selected from the group consisting of softwood fibers, secondary fibers, anfractuous fibers and mixtures thereof of at least approximately 50% by weight of the paper tissue comprising:

a first zone of foam-formed paper tissue formed from a furnish of predominantly hardwood fiber;

a second zone of foam-formed paper tissue formed from a furnish of predominantly strength and bulk enhancing fibers selected from the group consisting of softwood fibers, secondary fibers, anfractuous cellulosic fibers and mixtures thereof;

said second zone being formed unitary and entangled with said first zone to form a non-laminated stratified paper tissue;

a high softness integument being defined adjacent to an outer surface of said first zone; and a substratum being defined adjacent to a surface of said second zone spaced away from said integument;

said integument on said outer surface of said first zone includes an enriched region having a substantial purity of at least about 91% hardwood fiber and said substratum on said surface spaced away from said integument includes an enriched region having a substantial purity of said strength and bulk enhancing fiber, wherein said enriched region of substantially pure hardwood fiber provides an extremely soft and smooth surface, the overall amount of hardwood fiber supplied to form said first zone of said foam-formed non-laminated stratified paper tissue being no more than about 4.25 lbs per 3,000 sq. ft. ream.

2. The foam-formed non-laminated stratified paper tissue according to claim 1, wherein said enriched region of the integument has a purity of at least about 96% of hardwood fiber and up to 4.0% of said strength and bulk enhancing fibers.

3. The foam-formed non-laminated stratified paper tissue according to claim 2, wherein said enriched region of the substratum has a purity at least about 80% of said strength and bulk enhancing fibers and no more than 20% of hardwood fiber.

4. The foam-formed non-laminated stratified paper tissue according to claim 1, wherein said enriched region of the substratum has a purity of 94% to 95% of said strength and bulk enhancing fibers and 5% to 6% of hardwood fiber.

5. The foam-formed non-laminated stratified paper tissue according to claim 1, wherein the paper tissue is formed using a crescent forming configuration.

6. A foam-formed non-laminated stratified paper tissue comprising:

a first zone formed from a first foamed furnish consisting predominantly of hardwood fibers selected from the group consisting of hardwood kraft fibers and hardwood sulfite fibers;

a second zone formed from a second foamed furnish consisting predominantly of strength and bulk enhancing fibers selected from the group consisting of softwood fibers, secondary fibers, anfractuous and mixtures thereof;

said second zone being formed unitary and entangled with said first zone to form a non-laminated stratified paper tissue;

a high softness integument being defined adjacent to an outer surface of said first zone; and a substratum being defined adjacent to a surface of said second zone spaced away from said integument and consisting essentially of at least about 65% by weight of strength and bulk enhancing fibers selected from the group consisting of softwood fibers, secondary fibers, anfractuous fibers and mixtures thereof;

said integument on said outer surface of said first zone includes an enriched region having a concentration of said hardwood fibers of at least about 91% by weight and up to about 9% by weight of strength and bulk enhancing fibers selected from the group consisting of softwood fibers, secondary fibers, anfractuous fibers and mixtures thereof; and wherein said enriched region of substantially pure hardwood fibers provides an extremely soft and smooth surface, the overall amount of hardwood fiber supplied to form said first zone of said foam-formed non-laminated stratified paper tissue being no more than about 4.25 lbs per 3,000 sq. ft. ream.

7. A foam-formed non-laminated stratified paper tissue comprising:

a first zone formed from a first foamed furnish consisting predominantly of hardwood fibers selected from the group consisting of hardwood kraft fibers, hardwood sulfite fibers and mixtures thereof;

a second zone formed from a second foamed furnish consisting essentially of at least about 50% by weight of strength and bulk enhancing fibers selected from the group consisting of softwood kraft, secondary fibers, anfractuous cellulosic fibers and mixtures thereof;

said second zone being formed unitary and entangled with said first zone to form a non-laminated stratified paper tissue;

a high softness integument being defined adjacent to an outer surface of said first zone and consisting essentially of at least about 80% by weight of said hardwood fibers and up to about 10% by weight of said strength and bulk enhancing fibers; and a substratum being defined adjacent to a surface of said second zone spaced away from said integument and consisting essentially of at least about 65% by weight of strength and bulk enhancing fibers selected from the group consisting of softwood fibers, secondary fibers, anfractuous fibers and mixtures thereof;

said integument on said outer surface of said first zone includes an enriched region having a concentration of hardwood fibers of at least about 95% of the concentration of hardwood fiber in said first foamed furnish with a basis weight of at least 2.5 lb/ream and no less than the basis weight of the fiber applied in the first furnish minus 1.5 lb/ream, wherein said enriched region of substantially pure hardwood fiber provides an extremely soft and smooth surface, the overall amount of hardwood fiber supplied to form said first zone of said foam-formed non-laminated stratified paper tissue being no more than about 4.25 lbs per 3,000 sq. ft. ream.

8. A foam-formed two-ply stratified paper tissue comprising:

a non-laminated first ply of paper tissue and a non-laminated second ply of paper tissue in juxtaposed relationship relative to each other;

said first ply comprising:

a first zone of foam-formed paper tissue formed predominantly from hardwood fiber;

a second zone of foam-formed paper tissue formed predominantly from strength and bulk enhancing fibers selected from the group consisting of softwood fibers, secondary fibers, anfractuous cellulosic fibers and mixtures thereof;

said second zone being formed unitary and entangled with said first zone to form a non-laminated stratified paper tissue;

a high softness integument being defined adjacent to an outer surface of said first zone; and a substratum being defined adjacent to a surface of said second zone spaced away from said integument;

said integument on said outer surface of said first zone includes an enriched region having a substantial purity of at least about 91% hardwood fiber and said substratum on said surface spaced away from said integument and juxtaposed relative to said second ply includes an enriched region predominantly of said strength and bulk enhancing fibers wherein said enriched region of substantially pure hardwood fiber provides a first extremely soft and smooth exterior surface;

said second ply comprising:

a first zone of foam-formed paper tissue formed predominantly from hardwood fiber;

a second zone of foam-formed paper tissue formed predominantly from strength and bulk enhancing fibers selected from the group consisting of softwood fibers, secondary fibers, anfractuous fibers and mixtures thereof;

said second zone being formed unitary and entangled with said first zone to form a non-laminated stratified paper tissue;

a high softness integument being defined adjacent to an outer surface of said first zone; and a substratum being defined adjacent to a surface of said second zone spaced away from said integument;

said integument on said outer surface of said first zone includes an enriched region having a substantial purity of at least about 91% hardwood fiber and said substratum on said surface spaced away from said integument and juxtaposed relative to said first ply includes an enriched region having a substantial purity of strength and bulk enhancing fibers selected from the group consisting of softwood fibers, secondary fibers, anfractuous fibers and mixtures thereof, wherein said enriched region of substantially pure hardwood fiber provides a second extremely soft and smooth exterior surface, the overall amount of hardwood fiber supplied to each of said first zones being no more than about 4.25 lbs per 3,000 sq. ft. ream.

9. The foam-formed non-laminated stratified paper tissue product according to claim 8, wherein said enriched region of the integument of each ply has a purity of over 96% of hardwood fiber and up to 4% of said strength and bulk enhancing fibers.

10. The foam-formed non-laminated stratified paper tissue product according to claim 8, wherein said enriched region of the substratum has a purity of at least about 80% of said strength and bulk enhancing fibers and up to 20% of hardwood fiber.

11. The foam-formed non-laminated stratified paper tissue product according to claim 8, wherein said enriched region of the integument has a purity of 91% to 92% of hardwood fiber and 8% to 9% of said strength and bulk enhancing fibers.

12. The foam-formed non-laminated stratified paper tissue product according to claim 8, wherein said enriched region of the substratum has a purity of 94% to 95% of said strength and bulk enhancing fibers and 5% to 6% of hardwood fiber.

13. The foam-formed non-laminated stratified paper tissue product according to claim 8, wherein the paper tissue is formed using a crescent forming configuration.

14. A continuous method of forming a foam-formed non-laminated stratified web of paper tissue material comprising:

supplying a first furnish formed from a furnish supplied with hardwood fiber of no more than approximately 50% by weight of the paper tissue to a yankee side of a paper making machine for foam-forming a first zone;

supplying a second furnish formed from a furnish supplied with strength and bulk enhancing fibers selected from the group consisting of softwood fibers, secondary fibers and anfractuous fibers and mixtures thereof of at least approximately 50% by weight of the paper tissue to an air side of a paper making machine for form-forming a second zone;

forming said first and second zones in a unitary and entangled manner for forming the web of non-laminated stratified paper tissue by depositing said first and second furnishes on a foraminous substrate and draining whitewater therefrom, said whitewater being secondary and combined with said first and second furnishes;

forming a high softness integument on an outer surface of said first zone which includes an enriched region having a substantial purity of at least about 91% of the hardwood fiber content of said first furnish, the overall amount of hardwood fiber supplied to form said first zone of said foam-formed non-laminated stratified paper tissue being no more than about 4.25 lbs per 3,000 sq. ft. ream;

forming a substratum on a surface of said second zone spaced away from said integument and including an enriched region having a substantial purity of said strength and bulk enhancing fiber;

drying said first and second furnishes on a drying means to form said web of foam-formed paper tissue material having a predetermined dryness; and creping the foam-formed paper tissue material off of said drying means;

wherein said enriched region of substantially pure hardwood fiber of said web of foam-formed paper tissue provides an extremely soft and smooth surface.

15. The method of forming a foam-formed non-laminated stratified web of paper tissue according to claim 14, wherein said enriched region of the integument has a purity of over 96% of hardwood fiber and up to 4% of said strength and bulk enhancing fibers.

16. The method of forming a foam-formed non-laminated stratified web of paper tissue according to claim 14, wherein said enriched region of the substratum has a purity of over 80% of said strength and bulk enhancing fibers and up to 20% of hardwood fiber.

17. The method of forming a foam-formed non-laminated stratified web of paper tissue according to claim 14, wherein said web of foam-formed paper tissue is formed from a furnish having hardwood fiber of approximately 30% to 35% by weight of the paper tissue and said strength and bulk enhancing fibers of approximately 65% to 80% by weight of the paper tissue.

18. The method of crescent-forming a foam-formed non-laminated stratified web of paper tissue according to claim 14, wherein said enriched region of the integument has a purity of 91% to 92% of hardwood fiber and 8% to 9% of softwood fiber.

19. The method of crescent-forming a foam-formed non-laminated stratified web of paper tissue according to claim 14, wherein said enriched region of the substratum has a purity of 94% to 95% of softwood fiber and 5% to 6% of hardwood fiber.

20. The product made according to the method of claim 14.

21. A foam-formed non-laminated stratified paper product comprising:

a first zone formed from a first foamed furnish being supplied with hardwood fibers selected from the group consisting of hardwood kraft fibers, hardwood sulfite fibers and mixtures thereof constituting no more than about 50% by weight of the paper product, the overall amount of hardwood fiber supplied to form said first zone of said foam-formed non-laminated stratified paper product being no more than about 4.25 lbs per 3,000 sq. ft. ream.

a second zone formed from a second foamed furnish being supplied with strength and bulk enhancing fibers selected from the group consisting of softwood fibers, secondary fibers and anfractuous cellulosic fibers and mixtures thereof constituting at least about 50% by weight of the paper product;

said second zone being formed unitary and entangled with said first zone to form a non-laminated stratified paper product;

a high softness integument being defined adjacent to an outer surface of said first zone and consisting essentially of at least about 80% by weight of said hardwood fibers and up to about 20% by weight of said strength and bulk enhancing fibers; and a substratum being defined adjacent to a surface of said second zone spaced away from said integument and consisting essentially of at least about 65% by weight of strength and bulk enhancing fibers selected from the group consisting of softwood fibers, secondary fibers, anfractuous fibers and mixtures thereof;

said integument on said outer surface of said first zone includes an enriched region having a concentration of hardwood fiber of at least about 91% by weight of the concentration of hardwood fiber in said first foamed furnish, wherein said enriched region of substantially pure hardwood fiber provides an extremely soft and smooth surface.

22. A foam-formed non-laminated stratified paper product comprising:

a first zone formed from a first foamed furnish being supplied with hardwood fibers selected from the group consisting of hardwood kraft fibers, hardwood sulfite fibers and mixtures thereof consisting essentially of at least about 90% by weight hardwood fiber;

a second zone formed from a second foamed furnish being supplied with softwood fiber consisting essentially of at least about 70% by weight of strength and bulk enhancing fibers selected from the group consisting of softwood kraft, secondary fibers, and anfractuous cellulosic fibers and mixtures thereof;

said second zone being formed unitary and entangled with said first zone to form a non-laminated stratified paper product;

a third zone formed from a third foamed furnish being supplied with hardwood fiber selected from the group consisting of hardwood kraft fibers, hardwood sulfite fibers and mixtures thereof consisting essentially of at least about 90% by weight of hardwood fibers;

the overall amount of hardwood fiber being supplied to said first zone being no more than about 4.25 lbs per 3,000 sq. ft. ream;

the overall amount of hardwood fiber being supplied to said third zone being no more than about 4.25 lbs per 3,000 sq. ft.ream;

said third zone being formed unitary and entangled with said second zone to form a non-laminated stratified paper product;

two high softness integuments being defined adjacent to outer surfaces of said first and third zones; and a substratum being defined in the interior of said second zone spaced away from said integuments and consisting essentially of at least about 65% by weight of strength and bulk enhancing fibers selected from the group consisting of softwood fibers, secondary fibers, anfractuous fibers and mixtures thereof;

each said integuments on an outer surface of said first and third zones including an enriched region having a concentration of hardwood fiber of at least about 91% of the concentration of hardwood fiber in said foamed furnish forming each said zone, wherein said enriched region of substantially pure hardwood fiber provides an extremely soft and smooth surface.

23. The foam-formed non-laminated stratified paper tissue product according to claim 22, wherein the enriched region of each of said integuments having a concentration of hardwood fiber of at least about 91% has a basis weight of at least 2.5 lb/ream and no less than the basis weight of the fiber applied in the first furnish minus 1.5 lb/ream.

24. The foam-formed non-laminated stratified paper tissue product according to claim 22, wherein said enriched region of each of said integuments has a purity of at least about 96% of hardwood fiber and up to 4.0% of said strength and bulk enhancing fiber.

25. The foam-formed non-laminated stratified paper tissue product according to claim 22, wherein said enriched region of said substratum has a purity of at least about 80% of said strength and bulk enhancing fibers and no more than 20% of hardwood fiber.

26. The foam-formed non-laminated stratified paper tissue product according to claim 22, wherein said enriched region of said substratum has a purity of 94% to 95% of said strength and bulk enhancing fibers and 5% to 6% of hardwood fiber.

* * * * *